US007401856B2

(12) United States Patent
Marchand et al.

(10) Patent No.: US 7,401,856 B2
(45) Date of Patent: Jul. 22, 2008

(54) SEATING DEVICE

(75) Inventors: Denis Marchand, McMasterville (CA); Lyne Noiseux, McMasterville (CA)

(73) Assignee: Transfert Plus S.E.C., Montreal (CA)

( * ) Notice: Subject to any disclaimer, the term of this patent is extended or adjusted under 35 U.S.C. 154(b) by 254 days.

(21) Appl. No.: 11/211,554

(22) Filed: Aug. 26, 2005

(65) Prior Publication Data

US 2006/0103207 A1 May 18, 2006

Related U.S. Application Data

(63) Continuation of application No. 10/820,723, filed on Apr. 9, 2004, now Pat. No. 6,997,511.

(51) Int. Cl.
*A47C 1/02* (2006.01)

(52) U.S. Cl. ..... 297/314; 297/313; 297/344.21; 297/344.19

(58) Field of Classification Search ..... 297/4, 297/195.11, 314, 313, 461; D6/365, 364, D6/354; 248/530, 521
See application file for complete search history.

(56) References Cited

U.S. PATENT DOCUMENTS

| | | | | | |
|---|---|---|---|---|---|
| 2,551,996 | A | * | 5/1951 | Cherubini | 43/15 |
| 4,099,697 | A | * | 7/1978 | Von Schuckmann | 248/604 |
| 4,738,487 | A | * | 4/1988 | Shalinsky et al. | 297/338 |
| 4,807,841 | A | * | 2/1989 | Edstrom | 248/580 |
| D365,695 | S | * | 1/1996 | Sibbitt, Sr. | D6/364 |
| 5,941,263 | A | * | 8/1999 | Bierman | 135/68 |

* cited by examiner

*Primary Examiner*—Milton Nelson, Jr.
(74) *Attorney, Agent, or Firm*—Bereskin & Parr

(57) ABSTRACT

There is provided a sit-stand stool comprising a seat adapted to support a pelvis of a user and a base. The base supports the seat and is adapted to securely engage a floor. The base is adapted to provide a tilting motion of the seat, between a raised position and a forwardly inclined position, in a vertical plane about a pivot axis in accordance with the posture of the user while constraining the movement to prevent lateral tilting or inclination transverse to the vertical plane. The base is also adapted to prevent a rearward motion beyond the raised position, and a forward motion beyond the forwardly inclined position in order to reduce the risks for the user to lose stability. Such a stool permits to the user to stabilize his posture, without being in a completely seated position.

20 Claims, 10 Drawing Sheets

SEATING DEVICE

This application is a continuation of patent application Ser. No. 10/820,723 filed Apr. 9, 2004 now U.S. Pat. No. 6,997,511.

FIELD OF THE INVENTION

The present invention relates to improvements in the field of seating devices. More particularly, the invention relates to ergonomic seating devices.

BACKGROUND OF THE INVENTION

Several attempts have been made to provide ergonomic solutions for workers which have to perform tasks in both raised and seated positions. In fact, some tasks can hardly be performed while the worker is completely seated since they require a substantial mobility from the user. Thus, over long periods of work such tasks can be very tiring for workers. Some seating devices have been developed so as to provide these workers with a further point of support in addition to their legs so as to stabilize the posture of their body, without being in a completely seated position. By using these devices a worker can thus perform tasks in a raised position and in an intermediate position so-called a sit-stand position. Some of these devices are thus called sit-stand stools or seats.

Examples of these sit-stand stools are sold by the company Steelcase™ under the name B Free™. This stool comprises a base made of a flexible material which allows a user to incline the stool at various angled positions in various directions while performing a task. The stability of the stool is maintained by means of the grip of the flexible material to the floor.

U.S. Pat. No. 4,130,263 describes a stool having a stem connected to a sand-filed base. The base comprises a flexible bag filed with sand and this base can change of shape in response to displacement of the bag produced by a tilting of the stem. However, this stool can be substantially heavy for some users in view of the amount of sand required to maintain its stability. Such a base can also be bulky and cause obstruction to a user's feet particularly when the person is not using the stool.

U.S. Published Application No. 2003/0164633 describes a sitting device comprising a seat, a stem and a floor-contacting element which acts as a base. The base has a point of apex and an outside edge which permits a user to incline or tilt the stool at various angled positions in various directions.

Some workers are however reluctant to use any one of the above-mentioned stools since they can be tilted or inclined in any directions at various angled positions and it may be difficult for a user to stabilize them. The tilting of the stem can eventually generate a lost of stability and the user can even fall down. Moreover, the grip of the base member to the floor can be reduced by dust or other impurities and can cause the stool to skid, thereby exposing a user to potential injuries. Also, since these stools can be tilted in considerably inclined positions, their use in some small workspaces such as the cashier's workspace behind a check-out counter may not be appropriate.

It is well known for ergonomists that it is sometimes difficult to convince workers to perform tasks in a different manner than the way they have been doing these tasks for many years. It is also difficult to convince them to use new tools or devices to perform these tasks. It has been demonstrated over the years that new solutions such as new methods or devices presented as alternative solutions to workers must be simple, easy to use, safe and must offer considerable advantages over the known methods or devices in order to be adopted or used by the workers. There is therefore a need to provide a seating device which would be simple, safe, easy to use and which would overcome the above mentioned drawbacks.

SUMMARY OF THE INVENTION

It is therefore an object of the present invention to provide a seating device which overcomes the above drawbacks.

It is another object of the present invention to provide a seating device which is safe and easy to use and stabilize.

It is another object of the present invention to provide a seating device which provides a plurality of positions for a user.

It is another object of the invention to provide a seating device which permits a user to carry out tasks while sitting on it, without however considerably reducing his mobility.

It is another object of the invention to provide a seating device which is light, not bulky and easily stored.

According to one aspect of the invention, there is provided a seating device comprising:

a connecting element having a end portion dimensioned to be releasably and rotatably inserted into an aperture defined in a ground or a floor, the aperture being dimensioned to receive the connecting element so as to support the seating device; and a supporting element connected to a seat, the supporting element being pivotably connected to the connecting element, at least one of the connecting element and supporting element comprises at least one stop so as to permit the supporting element to pivot between a first position whereat the supporting element is in a substantially vertical position, and a second position whereat the supporting element is forwardly inclined of 30 degrees or less with respect to the first position.

According to another aspect of the invention, there is provided a seating device comprising:

a receiving element adapted to be fixed to a floor, the receiving element defining an internal bore;

a connecting element having a end portion dimensioned to be releasably and rotatably inserted into the bore so as to support the seating device; and a supporting element connected to a seat, the supporting element being pivotably connected to the connecting element, at least one of the connecting element and supporting element comprises at least one stop so as to permit the supporting element to pivot between a first position whereat the supporting element is in a substantially vertical position, and a second position whereat the supporting element is forwardly inclined of 30 degrees or less with respect to the first position.

According to still another aspect of the invention, there is provided a seating device comprising:

a seat; and a supporting element having a first member connected to the seat, and a second member having an end portion dimensioned to be releasably and rotatably inserted into a floor defining an aperture dimensioned to receive the one end portion so as to stabilize the second member within the aperture, the first and second member being pivotally connected together and the supporting element comprising at least one stop so that the first member is allowed to pivot between a first position whereat the first portion is in a substantially vertical position, and a second position whereat the first portion is forwardly inclined of 30 degrees or less with respect to the first position.

Applicants have found that by using any one of the seating devices as defined above, it is possible to provide a safe and efficient solution for persons who perform tasks in both raised and sited positions. These seating devices provide a safe support to persons who need to stabilize their posture without reducing their mobility. In fact, since these seating devices are prevented from being rearwardly inclined beyond a substantially vertical position, the risks for a user to loose stability or fall are thus reduced. Such devices permit to the user to have a good mobility since they can be rotated and forwardly inclined and allow the latter to perform various tasks while sitting on one of them. Moreover, since these seating devices are safely inserted and supported within the aperture or bore, tilting one of these devices will not cause lost of grip between the seating device and the surface or floor on which the device rests. In fact, the particular characteristics of the portion of the device inserted in the aperture, which acts as a "base", permits to avoid the drawbacks of the seating devices of the prior art concerning their limited grip to the surface on which they rest. The "base" of the seating devices of the invention is also non bulky thereby avoiding to generate obstruction to a user's feet. The seating devices of the invention provide a further point of support to a user and thus permit him to stabilize his posture and reduce the risks of premature fatigue or discomfort. The sit-stand position adopted by a user using one of the devices of the invention thus provides stability, mobility and comfort. By using any one of these seating devices, a user reduces the stress exerted on his legs and more particularly his knees, feet and ankles.

Applicants have also found that users generally feel safe when using the seating devices of the invention since tilting is limited between the first and second positions. In particular, the users trend to be more assured by using Applicants' devices since these devices cannot be rearwardly inclined beyond a substantially vertical position.

Applicants have also found that the seating devices of the present invention are particularly useful since they can be easily removed from the aperture and stored in a small area. When a user desires to use one of these devices, it can be easily inserted into an aperture or bore and when the user wants perform tasks without the device, it can be stored as example on a shelf of a counter. The device thus permits an easy handling and storing. Therefore, a user does not have to walk and carry the device over a considerable distance before using it or simply storing it.

According to yet another aspect of the present invention there is provided in a seating device comprising a seat, a tilting stem and a base, the improvement comprising the stem being pivotally connected to the base, and at least one of the stem and the base having at least one stop so as to permit the stem to pivot between a first position whereat the pivoting portion is in a substantially vertical position, and a second position whereat the pivoting portion is forwardly inclined of 30 degrees or less with respect to the first position.

According to a further aspect of the invention, there is provided in a seating device comprising a seat, a tilting stem and a base, the improvement comprising the base being dimensioned to be inserted in an aperture defined in a floor so that the base is rotatably and releasably inserted in the aperture so as to support the seating device, the base being dimensioned to avoid generating obstruction with a user's feet.

According to still a further aspect of the invention, there is provided a method for a person to stabilize his posture comprising the steps of:

a) providing a seating device comprising a seat connected to a stem, the stem being adapted to pivot between a first position whereat the stem is in a substantially vertical position, and a second position whereat the stem is forwardly inclined of 30 degrees or less with respect to the first position;

b) inserting a end portion of the stem into an aperture defined within a floor so as to stabilize the seating device; and c) sitting on the seat and selecting at least one position by inclining the stem, thereby providing a further point of support.

Applicants have found that by using such a method, a user is allowed to safely stabilize his posture thereby reducing the stress exerted on his legs. In particular, the method permits to reduce the stress exerted on the knees, ankles and feet of the user. This method also provides a safe and efficient solution for persons who perform tasks in both raised and sited positions to stabilize their posture. Such a method can also be applied by using any one of the seating devices described in the present invention.

The expression "substantially vertical position" as used herein refers to a position which can which extends at about 85 to about 95 degrees with respect to the ground or floor. Preferably, such a position extends at about 87 to about 93 degrees and more preferably at about 89 to about 91 degrees with respect to the ground or floor.

The term "floor" as used herein refers to the floor of a building or a vehicle.

The seating devices of the invention are preferably used on a floor being substantially flat. These devices are preferably stools and more preferably sit-stand stools. The seat and the supporting element are preferably coupled together so as to prevent rotation of the seat with respect to the supporting element. The end portion is preferably allowed to rotate freely within the aperture or bore according to an axis defined by the connecting element or the first member, respectively. The end portion preferably has a frusto-conical shape so as to facilitate its rotation within the aperture or bore. Preferably, the aperture or bore also has a frusto-conical shape.

When a seating device comprises a supporting element and a connecting element, a shaft can be connected to the connecting element and the supporting element can be rotatably mounted on the shaft. Preferably, the shaft is fixed to the connecting element and it comprises a threaded bolt provided with a nut. Alternatively, the supporting element and the connecting element can be pivotally connected together by means of a pivoting element. The pivoting element can be a shaft connected to the connecting element, the supporting element being mounted on the pivoting shaft. Preferably, the connecting element comprises a stop abutting a first portion of the supporting element at the first position, and abutting a second portion of the supporting element at the second position. A bias element can also be attached to the connecting element and to the supporting element so as to urge the supporting element in the first position. The seat preferably has a bottom surface or portion and the seat is preferably connected to one end of the supporting element, at the bottom surface or portion. The supporting element is preferably pivotally connected, at the other end, to the connecting element. The supporting element preferably comprises a rod connected to the seat, the rod being adjustably inserted in a stem so as to modify the length of the supporting element or the height of the seat with respect to the floor, and the stem being pivotally connected to the connecting element. Preferably, the supporting element comprises a pneumatic device so as to modify the length of the supporting element or the height of the seat with respect to the floor. In the second position, the supporting element is preferably inclined of 25 degrees or less, and more preferably of 20 degrees or less, with respect to the first position.

When a seating device comprises a supporting element having a first and a second member, the latter two members are preferably pivotally connected together by a shaft which is connected to the second member. The first member is pivotally mounted on the shaft. Preferably, the shaft is fixed to the second member and it comprises a threaded bolt provided with a nut. Alternatively, the first and second members can be pivotally connected together by means of a pivoting element. The pivoting element can be a shaft connected to the second member, the first member being mounted on the pivoting shaft. Preferably, at least one of the first and second members comprises a stop abutting a first portion of the supporting element at the first position, and abutting a second portion of the supporting element at the second position. A bias element can also be attached to the first and second members so as to urge the first member in the first position. The seat preferably has a bottom surface or portion and the seat is preferably connected to one end of the first member, at the bottom surface or portion. The first member is preferably pivotally connected, at the other end, to the second member. The first member preferably comprises a rod connected to the seat, the rod being adjustably inserted in a stem so as to modify the length of the supporting element or the height of the seat with respect to the floor, and the stem being pivotally connected to the connecting element. Preferably, the first member comprises a pneumatic device so as to modify the length of the supporting element or the height of the seat with respect to the floor. In the second position, the first member is preferably inclined of 25 degrees or less, and more preferably of 20 degrees or less, with respect to the first position.

When a seating device also comprises a receiving element, the latter preferably includes a first portion defining the internal bore. This first portion is adapted to be inserted in an aperture defined within the floor. The receiving element also includes a second portion connected to the first portion, the second portion being secured to the floor. The second portion is preferably dimensioned in order to avoid generating obstruction to a user's foot. The second portion can extend above the floor from less than 1 cm, and preferably form less than 0.30 cm.

The seating devices of the invention can further comprise an adjustment element for holding the supporting element in a selected inclined position so as to permit to a user to maintain the selected position without contacting the seating device. Advantageously, the seating devices comprise an adjustment element for modifying the tilt of the seat. The seat can also comprise a top surface having a periphery and a raised portion adjacent to the periphery. The raised portion is adapted to be grasped by at least one of the buttock muscles and ischial tuberosities of a user. Such a raised portion thus permits to reduce risks of sliding. It can also permit to the user to sit on the seat without use of his hands. The seating devices of the invention advantageously have a predetermined size so that they can be stored on a shelf below the top surface of a counter such as check-out counter as found in supermarkets or any retail stores. The seating devices of the invention can also comprise a footstool having an inclined surface for receiving user's feet, the surface being inclined in such a manner that a user's feet are upwardly extending. The footstool is advantageously disposed in proximity with the aperture or bore.

The preferred embodiments described above in respect of the seating devices according to the invention can also be applied to the method of the invention.

BRIEF DESCRIPTION OF THE DRAWINGS

Further features and advantages of the invention will become more readily apparent from the following description of preferred embodiments as illustrated by way of examples in the appended drawings wherein.

DESCRIPTION OF PREFERRED EMBODIMENTS

Figure 1:
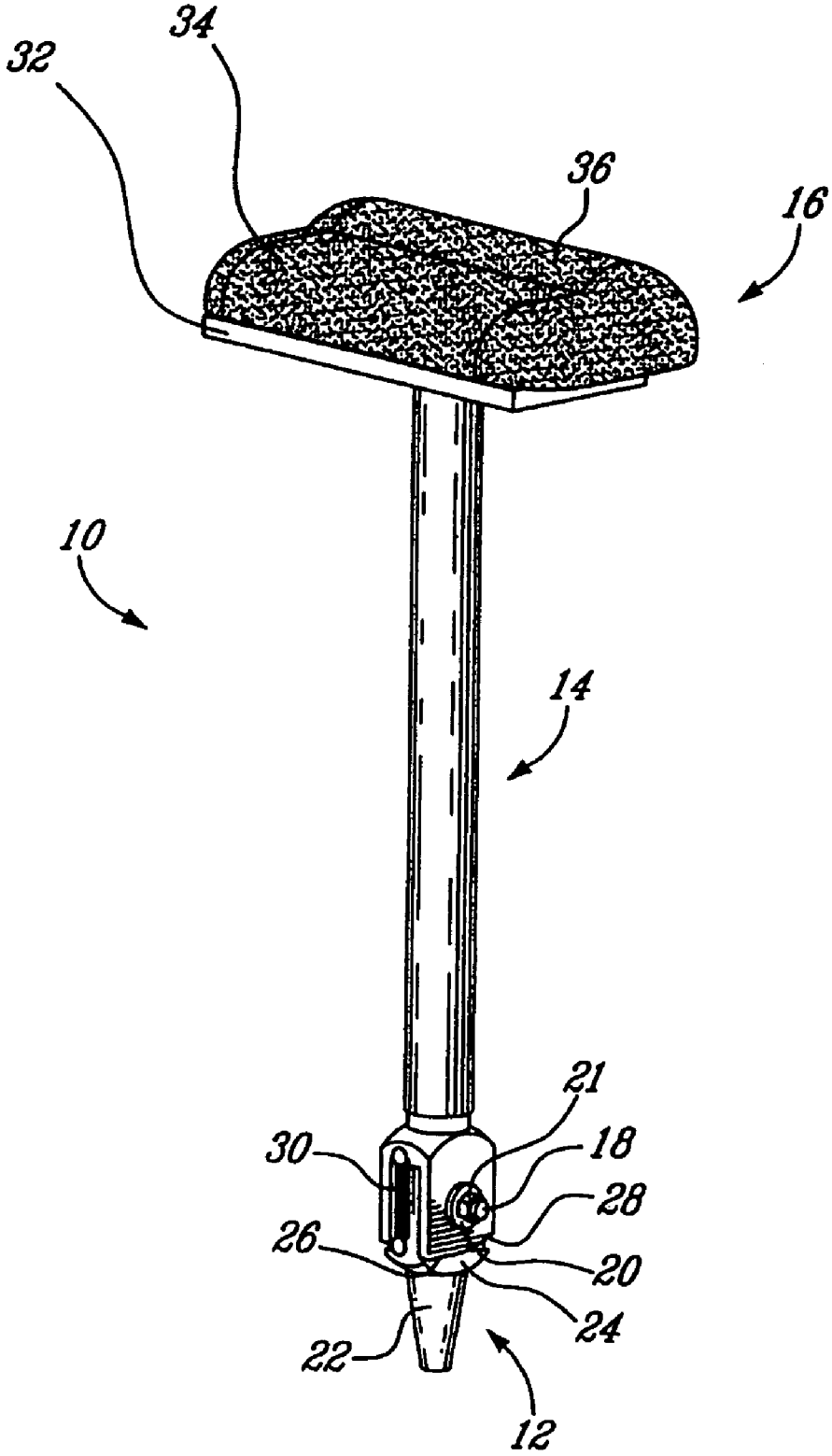
FIG. 1 is a rear perspective view of a seating device according to a preferred embodiment of the invention.
Figure 2:
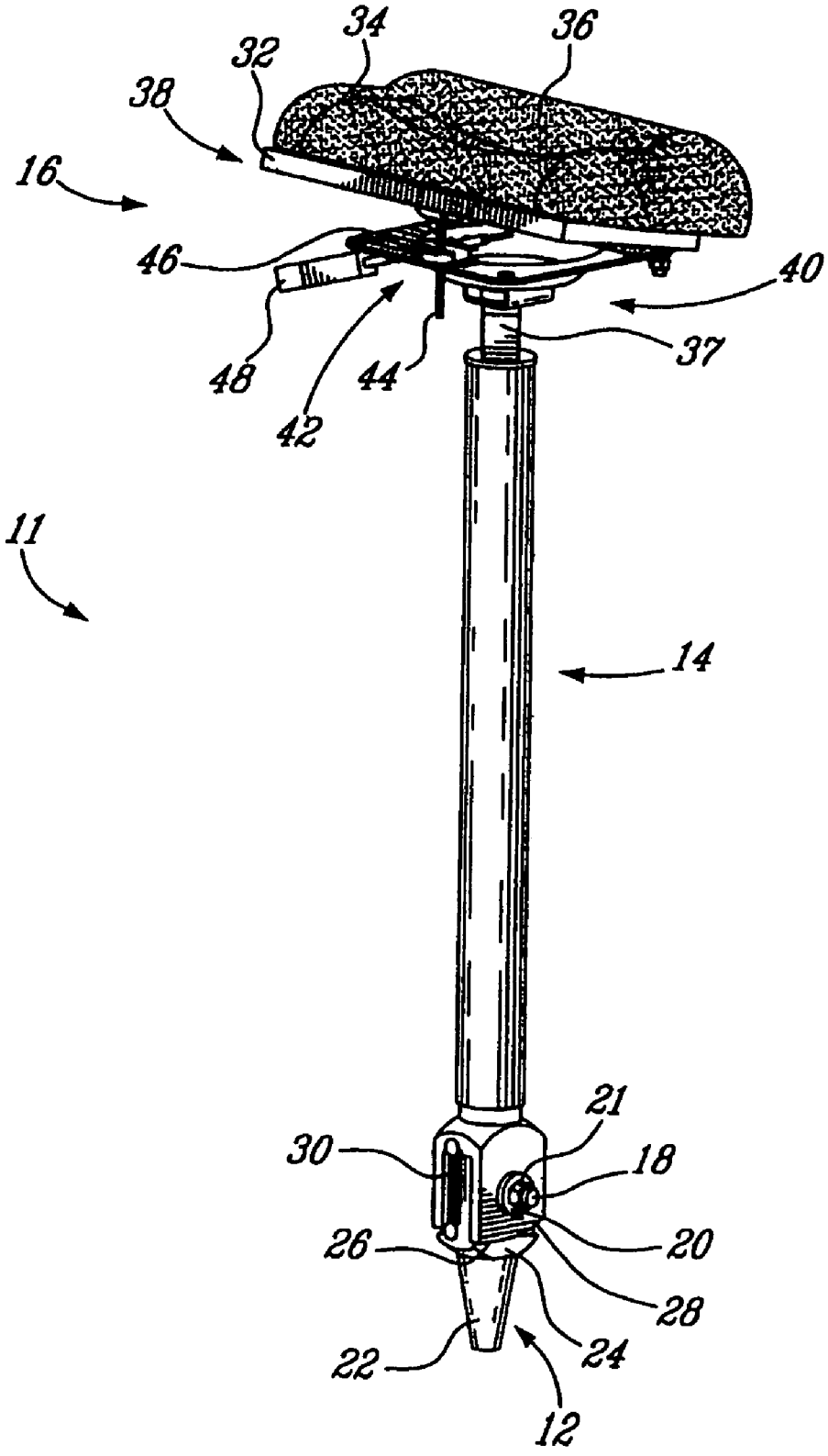
FIG. 2 is a rear perspective view of a seating device according to another preferred embodiment of the invention.

Referring first to FIGS. 1 and 2, there is shown a seating device 10 or 11 comprising a connecting element 12, a supporting element 14 and a seat 16. Seating devices 10 and 11 are similar, with the exception that the seating device 11 further comprises few adjustment elements. The connecting element 12 is pivotally connected to the supporting element 14. In fact, the supporting element 14 is mounted on a bolt 18 provided with a washer 20 and a nut 21. The connecting element 12 and the supporting element 14 both define apertures through which the bolt 18 is inserted and then inserted in the washer 20 and the nut 21, thereby pivotally connecting the latter two elements. The supporting element 14 and the connecting element 12 can also be pivotally connected by several other manners such as a shaft provided with rivets, a hinge or any means known to the person skilled in the art so as to pivotally connect the two elements together.

Figure 3:
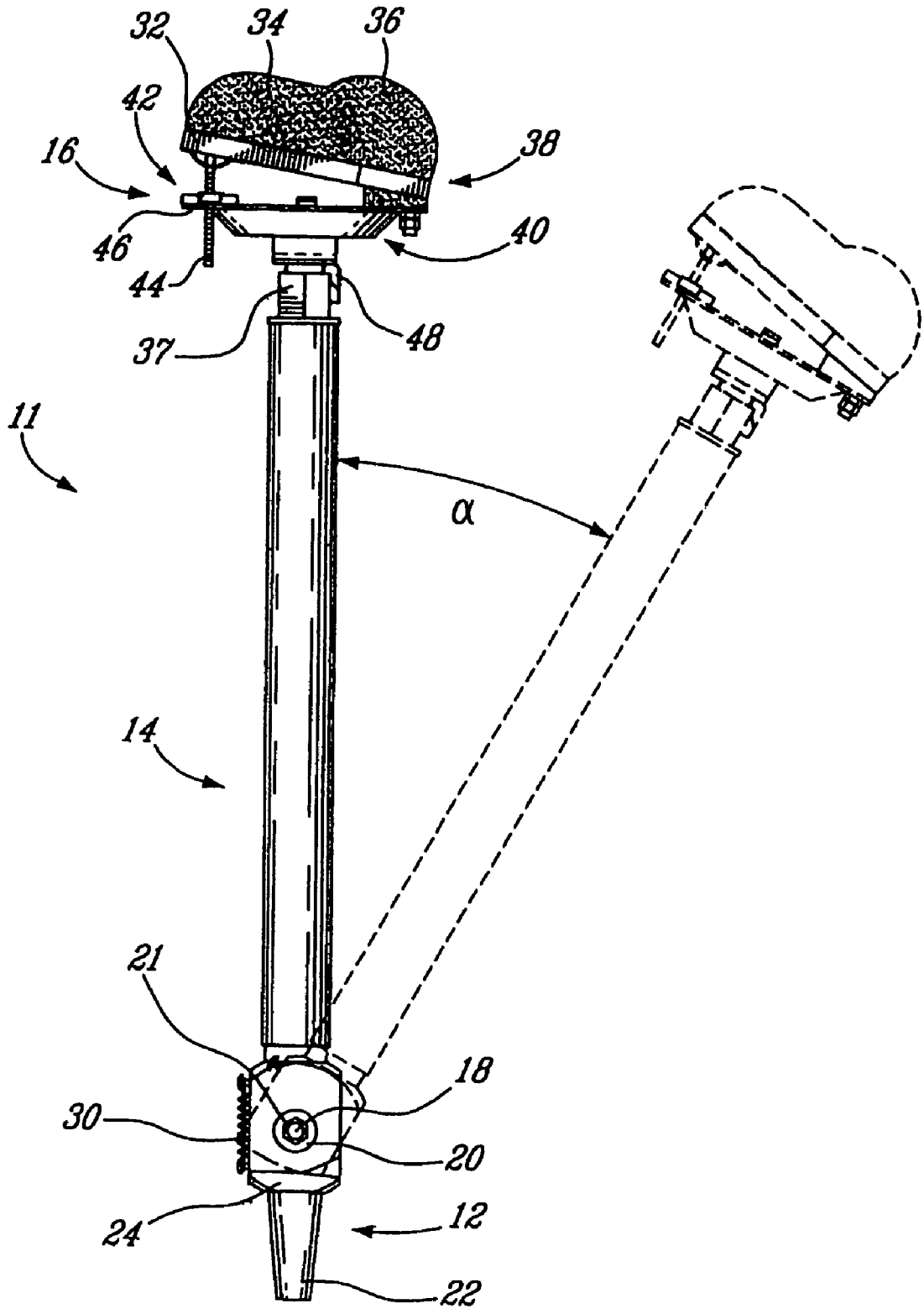
FIG. 3 is a side elevation view of the seating device shown in FIG. 2, wherein different positions of the seating device are shown.
Figure 4:
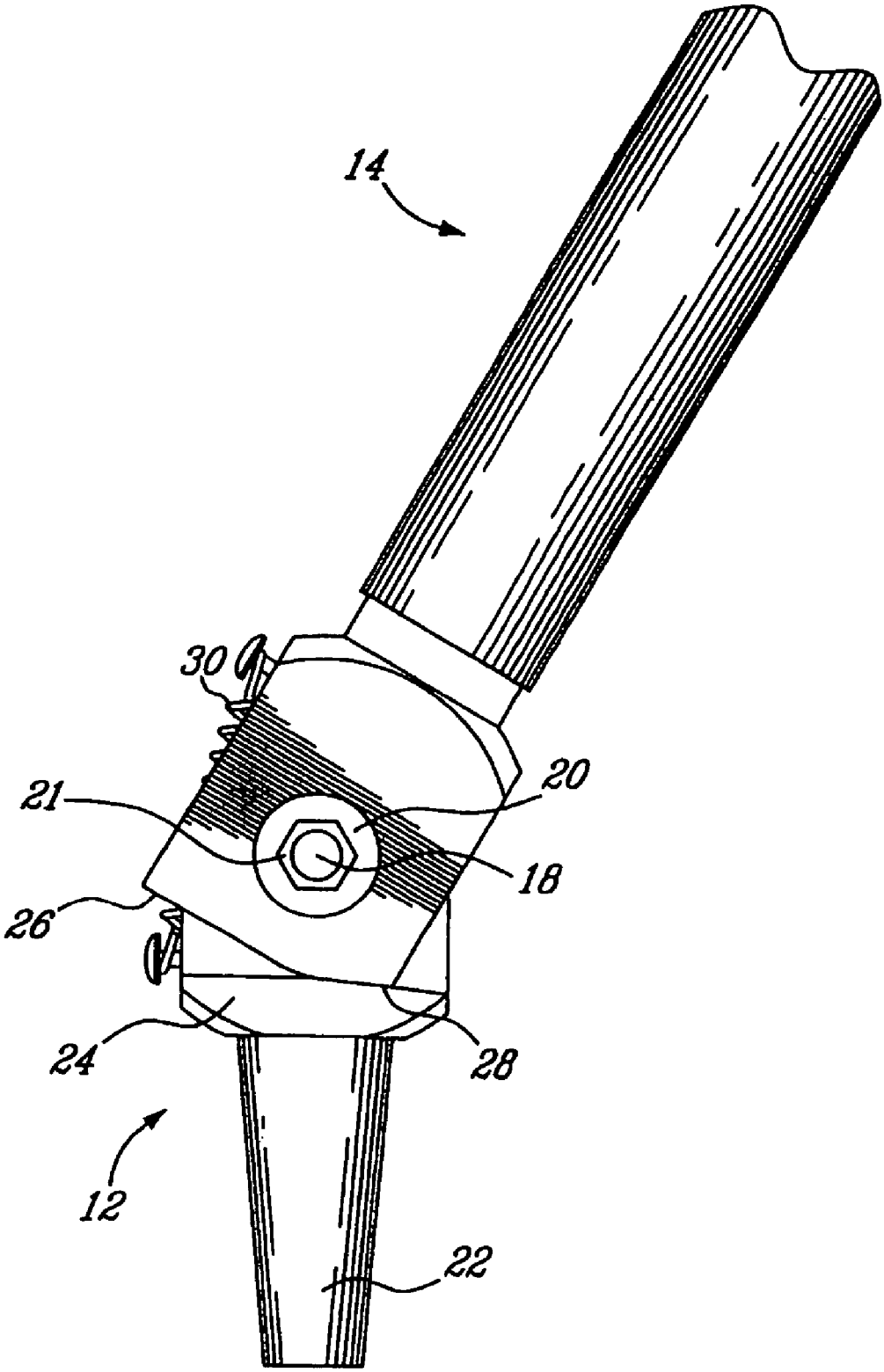
FIG. 4 is a side elevation view, partly fragmented, of the seating device shown in FIG. 3, wherein the seating device is shown in an inclined position.
Figure 5:
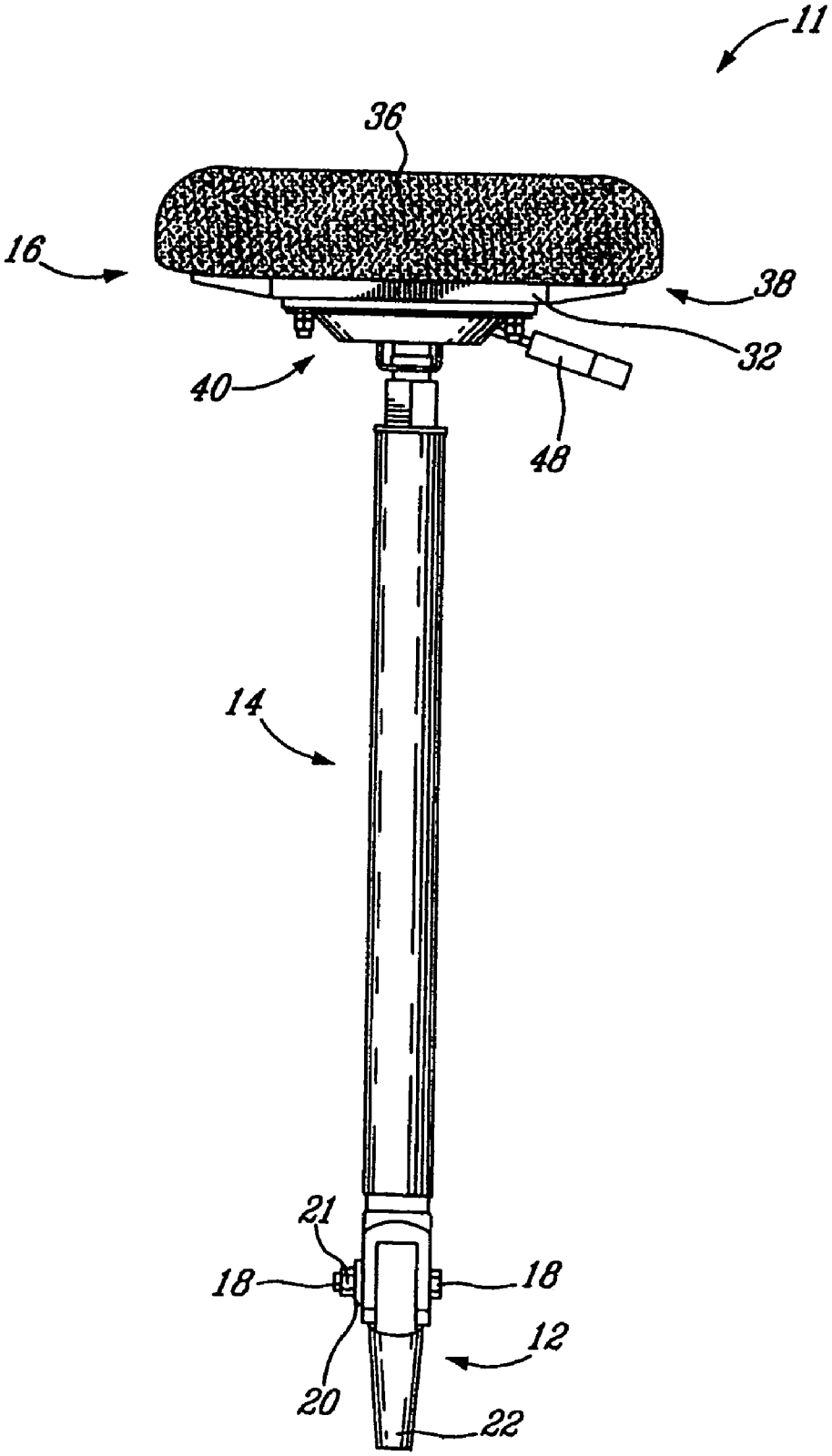
FIG. 5 is a rear elevation view of the device shown in FIG. 2.

The connecting element 12 has an end portion 22 having a frusto-conical shape and which is adapted to be inserted in an aperture defined in a floor so as to support the seating device 10 or 11. The connecting element 12 also comprises a stop 24 which abuts a first portion 26 of the supporting element 14 in a raised or first position and a second portion 28 of the supporting element 14 in an inclined or second position (FIGS. 1 to 4). The stop 24 thus permits the supporting element 14 to pivot between a first position where it extends substantially vertically and a second position where it is inclined according to the angle $\alpha$ (FIG. 3). The angle $\alpha$ has a value of about 30 degrees or less, preferably about 25 degrees or less and more preferably about 20 degrees or less. The stop 24 thus prevents the supporting element 14 from being tilted or inclined rearwardly beyond a substantially vertical position, and forwardly beyond the second position. Alternatively, a stop can be disposed on said supporting element as it can be seen from FIG. 4, both portion 28 and stop 24 comprise a recessed or rounded portion so as to permit the supporting element 14 to be forwardly inclined. The connecting element 12 and the supporting element 14 are also connected together by a bias element such as a bias spring 30 which urges the supporting element 14 in the raised or first position.

Thus, when a user is sitting on the seating device 10 or 11 stands up and leaves his sitting position, the supporting element 14 will automatically pivot from an inclined position to the raised or first position. Optionally, the nut 21 can be adjusted in such a manner to increase the friction between element 12 and 14 so that the spring 30 will not be sufficient to urge the inclined supporting element 14 in the first portion. Thus, such an adjustment will permit to the user to maintain a selected inclined position even without holding or contacting the device. Such an option can be particularly useful if the user quits his sitting position for few moments and he then wants to quickly adopt again the same sitting position without being obligated to adjust the device one more time so as to select this particular position. From these explanations, it will be understood by the person skilled in the art that other adjustment elements can be provided in replacement of the nut 21, and which will be more easily adjusted by the user.

As shown in FIG. 1, the seat 16 comprises a seat panel 32 secured to the supporting element 14, and a seating portion 34. The seating portion 34 preferably comprises a cushion. The seating portion 34 further comprises a lip or raised portion 36 which permits the user to easily grab the seat with his buttocks muscles and/or with his ischial tuberosities without using his hands. Moreover, such a raised portion reduces the risks for the user to loose grip and slide when contacting the seating portion with his muscles and/or ischial tuberosities.

As shown in FIGS. 2, 3 and 5 to 7, the seat 16 can be connected to the supporting element 14 by means of a coupling element 37 having a parallelepiped shape so as to prevent the rotation of the seat 16 with respect to the supporting element 14. The seat 16 can further comprises adjustment devices. A top portion 38 including the seating portion 34 having a lip 36 and the seat panel 32 is connected to a bottom portion 40 by means of an adjustment element 42. The seat panel 32 is connected to the bottom portion 38 by means of the adjustment element 42 which comprises a threaded rod 44 inserted in a screw nut 46. The top portion 38 can thus be inclined with respect to the bottom portion 42 by adjusting the screw nut 46. It has been found that by using such an adjustment element, it is possible to limit the space required for the operating radius of the device in view of the tilt of the seat 16. The seating device 11 also comprises an actuating lever 48 coupled with a pneumatic device such as a pneumatic compression spring assembly i.e. a telescoping cylinder-piston assembly (not shown) which permits to adjust the length of the supporting element 14 (or the height of the seat 16 with respect to the floor). The pneumatic device can be as example a pneumatic compression spring assembly is one as usually used in the manufacture of chair or the like and it comprises a slidable piston attached to a piston rod which is inserted in the supported member 14 acting as a housing.

Alternatively, the supporting element can comprises a rod connected to the seat and slidably inserted in a housing comprising a clamping device so as to adjust the length of the supporting element. Such an adjustable supporting element is described in U.S. Pat. No. 4,130,263, which is hereby incorporated by reference. Moreover, the supporting element can comprise a housing having an interior threaded section in which a spindle is inserted, the spindle being connected to the seat. Such an adjustable supporting element is described in U.S. Pat. No. 6,644,742, which is hereby incorporated by reference.

Figure 6:
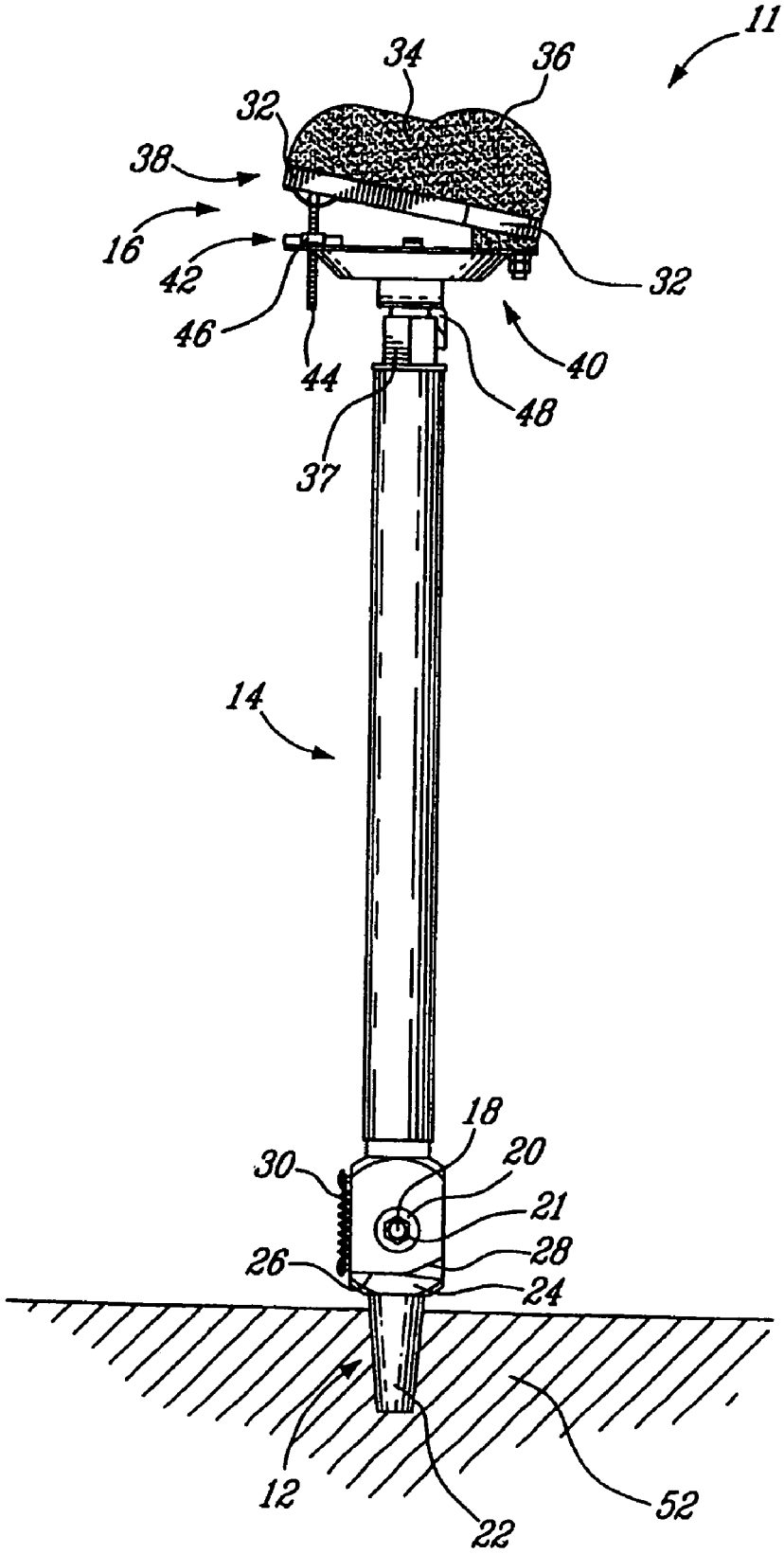
FIG. 6 is a side elevation view of the seating device shown in FIG. 2, wherein the seating device is inserted in an aperture defined in a floor.

FIG. 6 shows the seating device 11 which has been inserted in an aperture defined in a floor 52, the aperture being dimensioned to receive the connecting element 12. The floor 52 is preferably a floor comprising a resistant material such a metal or concrete.

Figure 7:
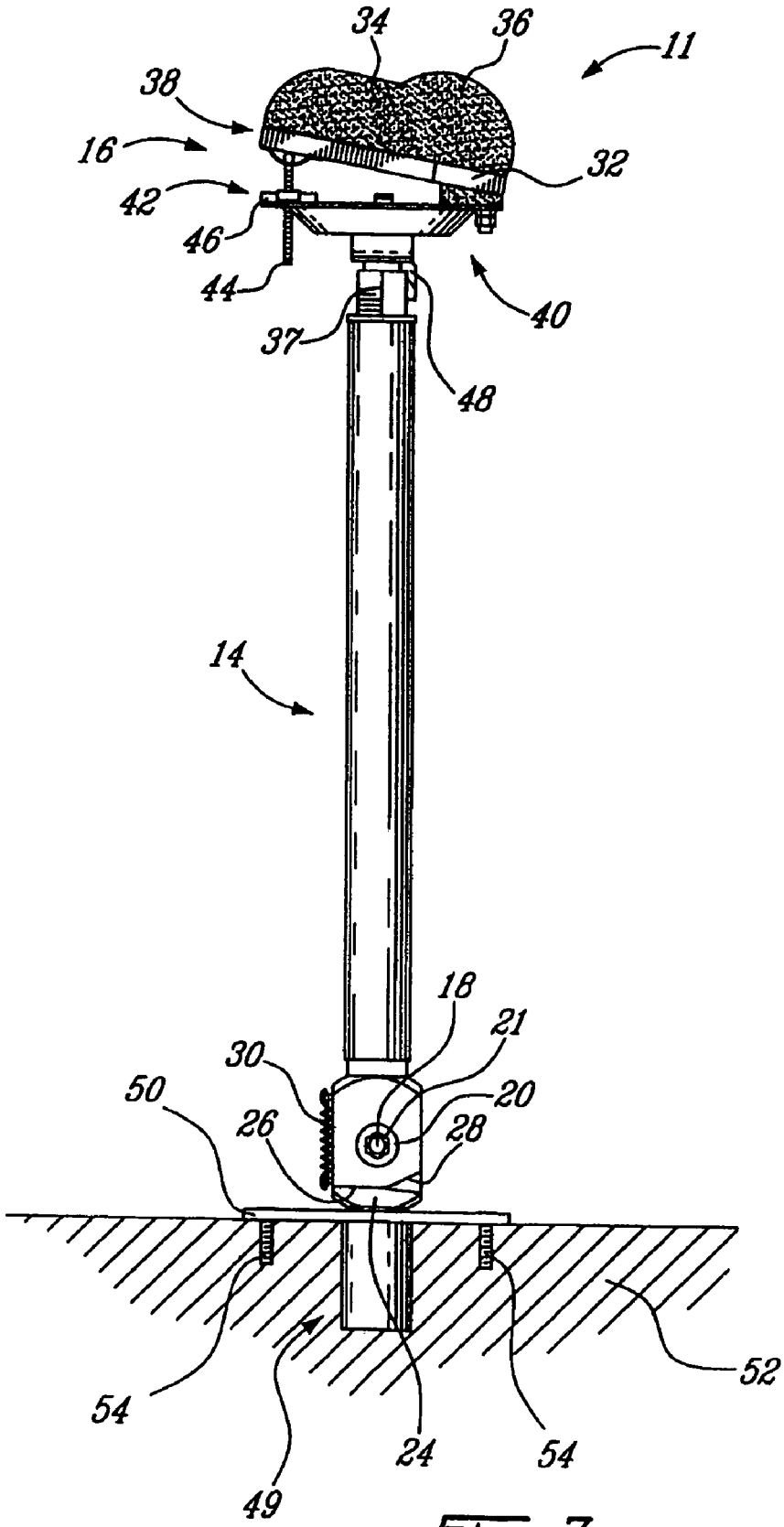
FIG. 7 is a side elevation view of the seating device shown in FIG. 2, wherein the seating device is inserted in a receiving element according to another preferred embodiment of the invention.

FIG. 7 shows the seating device 11 inserted in a receiving element 49 comprising an internal bore (not shown) adapted to receive the portion 22 of the connecting element 12. The internal bore can also be provided with Teflon® so as to facilitate rotation of the portion 22, thereby reducing friction. The receiving element 49 also has a flat portion 50 contacting the floor 52. The flat portion 50 defines apertures (not shown) in which fasteners 54 such as screws or bolts are inserted so as to secure the receiving element 50 to the floor. Such a flat portion and fasteners are preferably as thin as possible so as to prevent generating obstruction to a user's foot. Thus, when the device is stored, the presence of the receiving element 49 does not cause any inconvenience to a person walking on the floor. Optionally, the hole defined by the internal bore can be covered by a cap when the device is not inserted therein.

Figure 8:
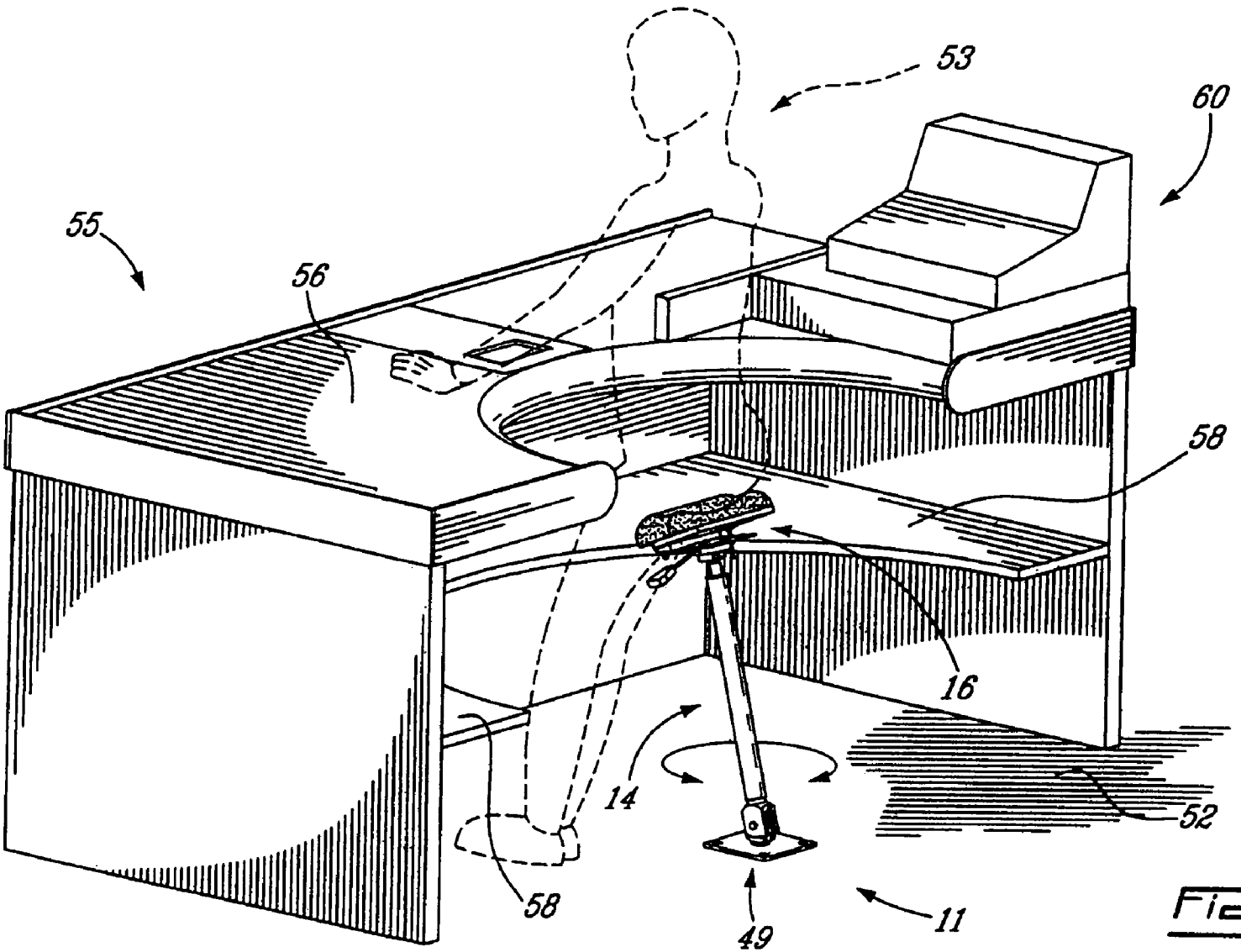
FIG. 8 is a rear perspective view of a seating device according to another preferred embodiment of the invention.
Figure 9:
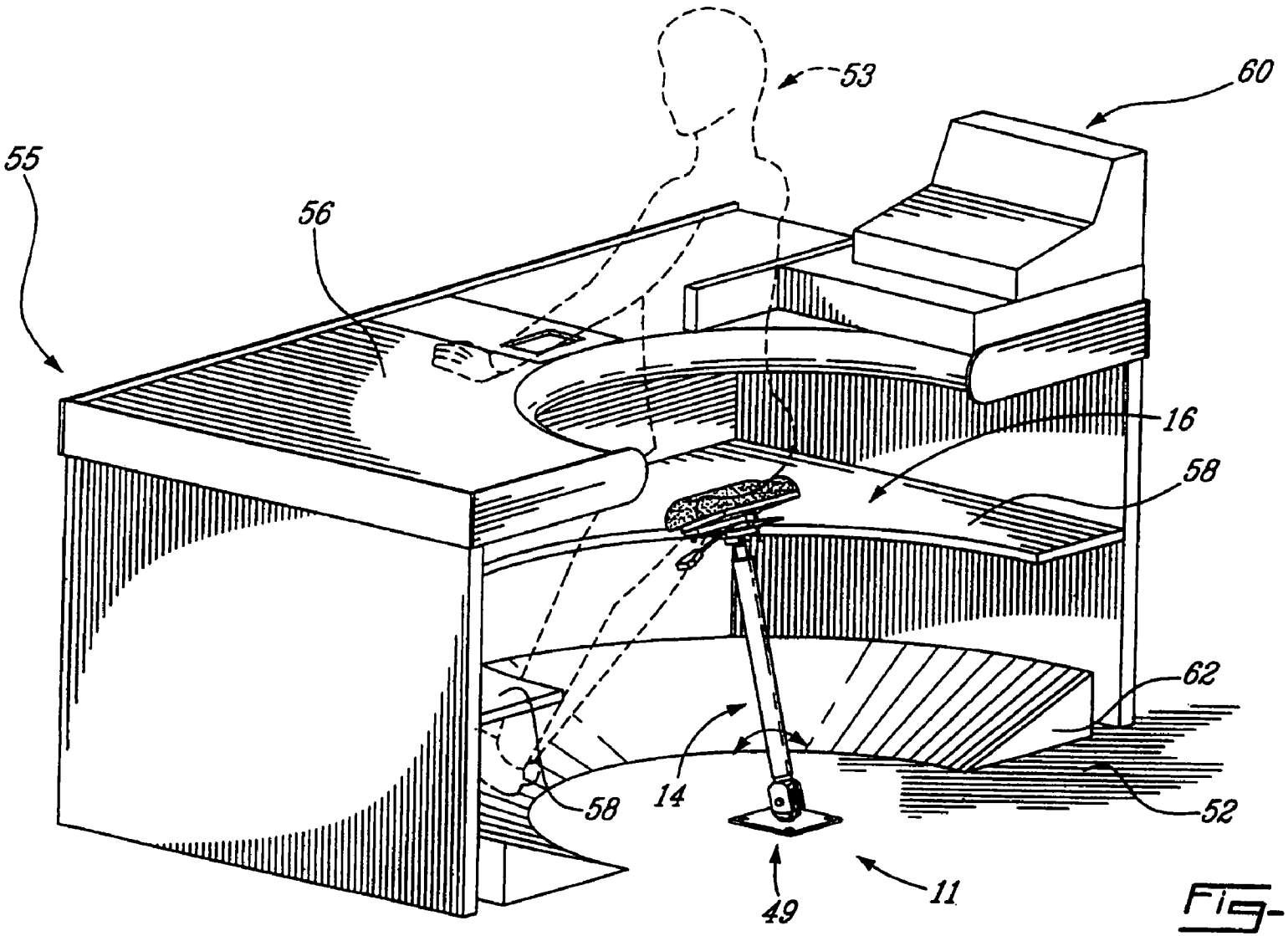
FIG. 9 is a rear perspective view of a seating device according to another preferred embodiment of the invention.
Figure 10:
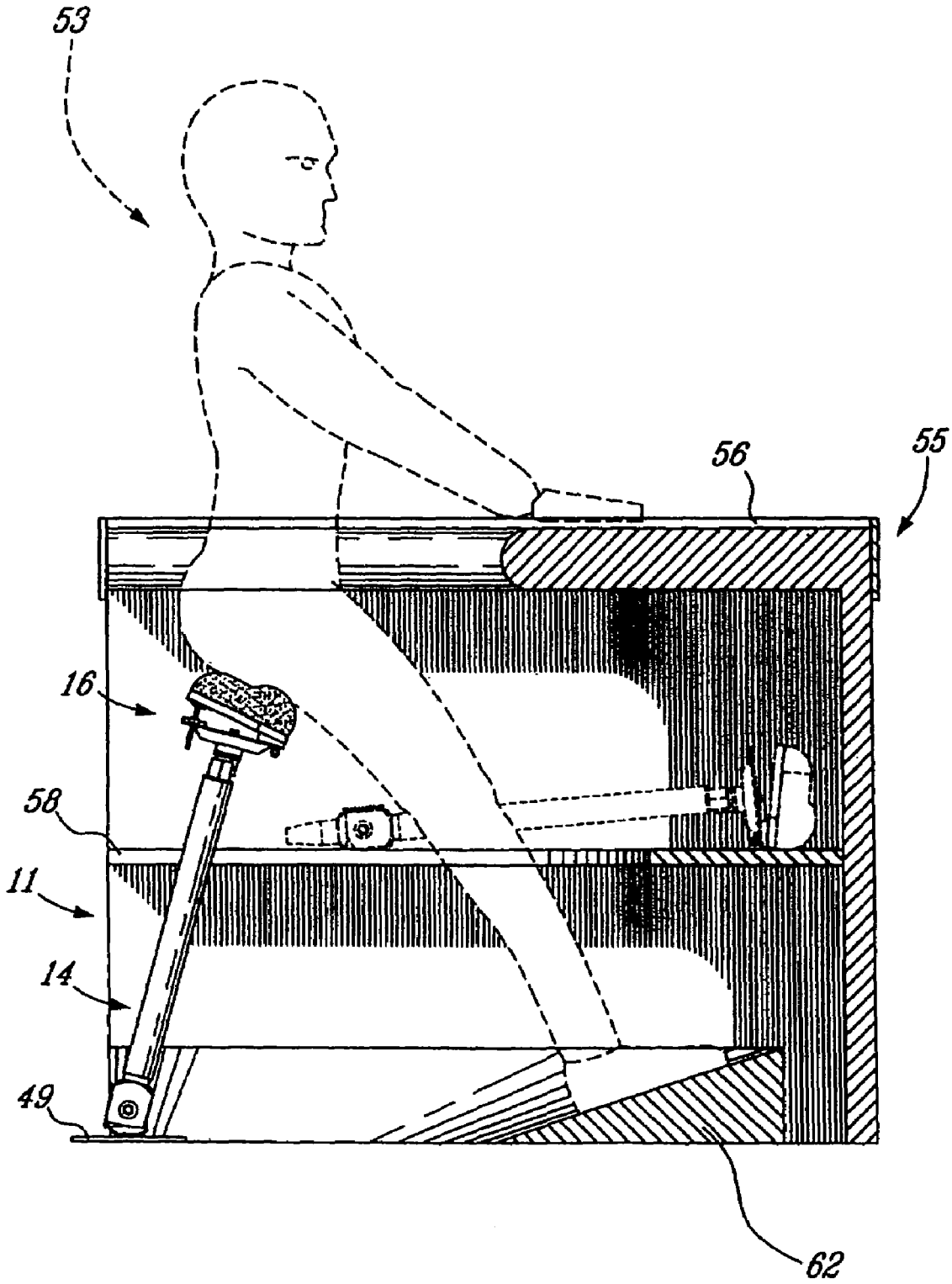
FIG. 10 is a side elevation view of a seating device shown in FIG. 9, wherein the device is also shown as stored on a shelf.

As shown in FIGS. 8 to 10 the seating devices of the present invention can be particularly useful for a person 53 working as a cashier for example. Usually such workers perform tasks which necessitate a certain mobility. In particular, these persons manipulates purchased articles on a check-out counter 55 having a top surface 56 and a shelf 58, as well as perform tasks with a cash register 60. Over extended period of times such tasks requiring several displacements can be very tiring since the persons usually stands up. When using one of the devices of the present invention the user can thus stabilize his posture has shown in FIGS. 8 to 10 while maintaining a good mobility since these devices can be rotated and forwardly inclined.

As shown in FIG. 10, the seating device 11 is not bulky and can easily be stored on the shelf 58. Preferably, the seating device 11 has a weight of 3.75 kg or less and more preferably of 2.25 kg or less. When the person wants to use the device, the latter just needs take it from the shelf 58 and insert the end portion 22 (FIGS. 2 to 4) into the bore defined in the receiving element 49 (FIGS. 7 to 10) so as to support the seating device 11. Then, the person can grab the raised portion 36 (FIGS. 2 and 3) with his buttock muscles and/or ischial tuberosities so as to sit on the seat 16. Before or while sitting on the seat 16, the person can adjust the tilt of the seat 16 with the adjustment element 42. The person can also adjust the height of the seat 16 with respect to the floor 52, by means of the lever 48.

The person thus sitting or being supported by the device in a sit-stand position can rotate the latter or tilt it so as to perform his tasks. If the person quits the device, the spring 30 (FIGS. 3 and 4) will urge the seating device in the first position. Optionally, the nut 21 (FIGS. 1 to 4) can be adjusted so as to hold the device in a particular inclined position. When the person wants to store the seating device 11, the latter simply has to remove the device from the receiving element 49 and store it on the shelf 58.

As shown in FIG. 8, the person 53 adopting a sit-stand position is provided with supplemental point of supports since he is sitting on the seating device 11 and his hands are abutting the top surface 56. For extra stability and comfort, the device of the invention can be provided with a footstool 62

(FIGS. 9 and 10) having an inclined surface so as to permit to the person 53 to reduce the stress exerted on his feet, knees and ankles. The slope of the footstool 62 is preferably of about 15 to about 25 and preferably about 20 degrees. The top surface of the footstool 62 can be advantageously provided with a non-slip material like a polymeric material or a rubber-like material.

The seating device and method of the present invention can be used by different workers in different job environments. As examples they can be used by cashiers and clerks in retail stores, supermarkets and banks. They can also be used by persons working in laboratories or workers in a plant. The seating device and method of the present invention can be used for practicing various types of hobbies such as fishing and hunting. As example, such a device can be inserted in the floor of a boat thereby providing a supplemental point of support to a fisher while permitting him to have a good mobility. The device can also be used as an alternative to the traditional stools used by musicians such as guitar players. It can further be used by percussionists.

While the invention has been described with particular reference to the illustrated embodiment, it will be understood that numerous modifications thereto will appear to those skilled in the art. Accordingly, the above description and accompanying drawings should be taken as illustrative of the invention and not in a limiting sense.

What is claimed is:

1. A sit-stand stool comprising:

a seat adapted to support a pelvis of a user; and a base supporting the seat and adapted to securely engage a floor, said base comprising a supporting element, connected to said seat, for pivotal movement about a pivot point and being adapted to provide a tilting motion of said seat, between a raised position and a forwardly inclined position, in a vertical plane about a pivot axis in accordance with a posture of a user, said seat having a bottom surface and said seat being connected to one end of said supporting element, at said bottom surface, said base further comprising at least one stop for constraining movement of said supporting element to prevent lateral tilting or inclination transverse to said vertical plane, said at least one stop being also adapted to prevent a rearward motion beyond said raised position, and a forward motion beyond said forwardly inclined position wherein in said forwardly inclined position said supporting element is inclined at 30 degrees or less with respect to said raised position in order to reduce risks for said user to lose stability, thereby providing said user with a further point of support in addition to his legs so as to stabilize a posture of his body without being in a completely seated position while allowing for movement between said raised and forwardly inclined positions.

2. The sit-stand stool of claim 1, wherein said seat and said supporting element are coupled together, thereby preventing rotation of said seat with respect to said supporting element.

3. The sit-stand stool of claim 1, wherein said base comprises a connecting element having a end portion dimensioned to be releasably and rotatably inserted into an aperture defined in a ground or a floor, said aperture being dimensioned to receive said connecting element so as to support said sit-stand stool.

4. The sit-stand stool of claim 1, wherein in the forwardly inclined position, said supporting element is forwardly inclined at 25 degrees or less with respect to said raised position.

5. The sit-stand stool of claim 1, wherein in the forwardly inclined position, said supporting element is forwardly inclined at 20 degrees or less with respect to said raised position.

6. The sit-stand stool of claim 1, wherein said raised position is a substantially vertical position.

7. The sit-stand stool of claim 1, wherein said base comprises a receiving element adapted to be fixed to a floor, said receiving element defining an internal bore; and a connecting element having a end portion adapted to be releasably and rotatably inserted into said bore.

8. The sit-stand stool of claim 7, wherein said receiving element comprises:

a first portion defining said internal bore, said first portion being adapted to be inserted in an aperture defined within said floor; and a second portion connected to said first portion, said second portion being adapted to be secured to said floor.

9. The sit-stand stool of claim 1, wherein said base comprises a connecting element pivotally connected to said supporting element, said connecting element being adapted to securely engage the floor.

10. The sit-stand stool of claim 9, wherein said connecting element comprises a stop abutting a first portion of said supporting element at said raised position, and abutting a second portion of said supporting element at said forwardly inclined position.

11. The sit-stand stool of claim 9, further comprising a bias element attached to said connecting element and to said supporting element so as to urge said supporting element in said raised position.

12. The sit-stand stool of claim 9, wherein said supporting element comprises a rod connected to said seat, said rod being adjustably inserted in a stem so as to modify the length of said supporting element, and said stem being pivotally connected to said connecting element.

13. A sit-stand stool comprising:

a seat adapted to support a pelvis of a user; and a base supporting the seat and adapted to securely engage a floor, said base comprising a supporting element, connected to said seat, for pivotal movement about a pivot point and being adapted to provide a tilting motion of said seat, between a raised position and a forwardly inclined position, in a vertical plane about a pivot axis in accordance with a posture of a user, said base comprising a connecting element pivotally connected to said supporting element, said connecting element being adapted to securely engage the floor and being attached to a bias element which is attached to said supporting element so as to urge said supporting element in said raised position, said base further comprising at least one stop for constraining movement of said supporting element to prevent lateral tilting or inclination transverse to said vertical plane, said at least one stop being also adapted to prevent a rearward motion beyond said raised position, and a forward motion beyond said forwardly inclined position wherein in said forwardly inclined position said supporting element is inclined at 30 degrees or less with respect to said raised position in order to reduce risks for said user to lose stability, thereby providing said user with a further point of support in addition to his legs so as to stabilize a posture of his body without being in a completely seated position while allowing for movement between said raised and forwardly inclined positions.

14. The sit-stand stool of claim 13 wherein said seat has a bottom surface, said seat being connected to one end of said supporting element, at said bottom surface.

15. The sit-stand stool of claim 13, wherein in the forwardly inclined position, said supporting element is forwardly inclined at 20 degrees or less with respect to said raised position.

16. The sit-stand stool of claim 13, wherein said raised position is a substantially vertical position.

17. A sit-stand stool comprising:

a seat adapted to support a pelvis of a user; and a base supporting the seat and adapted to securely engage a floor, said base comprising a supporting element, connected to said seat, for pivotal movement about a pivot point and being adapted to provide a tilting motion of said seat, between a raised position and a forwardly inclined position, in a vertical plane about a pivot axis in accordance with a posture of a user, said base comprising a connecting element pivotally connected to said supporting element, said connecting element being adapted to securely engage the floor, said supporting element comprising a rod connected to said seat, said rod being adjustably inserted in a stem so as to modify the length of said supporting element, and said stem being pivotally connected to said connecting element, said base further comprising at least one stop for constraining movement of said supporting element to prevent lateral tilting or inclination transverse to said vertical plane, said at least one stop being also adapted to prevent a rearward motion beyond said raised position, and a forward motion beyond said forwardly inclined position wherein in said forwardly inclined position said supporting element is inclined at 30 degrees or less with respect to said raised position in order to reduce risks for said user to lose stability, thereby providing said user with a further point of support in addition to his legs so as to stabilize a posture of his body without being in a completely seated position while allowing for movement between said raised and forwardly inclined positions.

18. A sit-stand stool comprising:

a seat adapted to support a pelvis of a user; and a base supporting the seat and adapted to securely engage a floor, said base comprising a supporting element, connected to said seat, for pivotal movement about a pivot point and being adapted to provide a tilting motion of said seat, between a raised position and a forwardly inclined position, in a vertical plane about a pivot axis in accordance with a posture of a user, said base comprising a connecting element having an end portion dimensioned to be releasably and rotatably inserted into an aperture defined in a ground or a floor, said aperture being dimensioned to receive said connecting element so as to support said sit-stand stool, said base further comprising at least one stop for constraining movement of said supporting element to prevent lateral tilting or inclination transverse to said vertical plane, said at least one stop being also adapted to prevent a rearward motion beyond said raised position, and a forward motion beyond said forwardly inclined position wherein in said forwardly inclined position said supporting element is inclined at 30 degrees or less with respect to said raised position in order to reduce risks for said user to lose stability, thereby providing said user with a further point of support in addition to his legs so as to stabilize a posture of his body without being in a completely seated position while allowing for movement between said raised and forwardly inclined positions.

19. A sit-stand stool comprising:

a seat adapted to support a pelvis of a user; and a base supporting the seat and adapted to securely engage a floor, said base comprising a supporting element, connected to said seat, for pivotal movement about a pivot point and being adapted to provide a tilting motion of said seat, between a raised position and a forwardly inclined position, in a vertical plane about a pivot axis in accordance with a posture of a user, said base comprising a receiving element adapted to be fixed to a floor and defining an internal bore; said base comprising a connecting element having a end portion adapted to be releasably and rotatably inserted into said bore, said base further comprising at least one stop for constraining movement of said supporting element to prevent lateral tilting or inclination transverse to said vertical plane, said at least one stop being also adapted to prevent a rearward motion beyond said raised position, and a forward motion beyond said forwardly inclined position wherein in said forwardly inclined position said supporting element is inclined at 30 degrees or less with respect to said raised position in order to reduce risks for said user to lose stability, thereby providing said user with a further point of support in addition to his legs so as to stabilize a posture of his body without being in a completely seated position while allowing for movement between said raised and forwardly inclined positions.

20. The sit-stand stool of claim 19, wherein said receiving element comprises:

a first portion defining said internal bore, said first portion being adapted to be inserted in an aperture defined within said floor; and a second portion connected to said first portion, said second portion being adapted to be secured to said floor.

* * * * *